US011866997B2

(12) United States Patent
Escolle et al.

(10) Patent No.: US 11,866,997 B2
(45) Date of Patent: Jan. 9, 2024

(54) ROTARY PERCUSSIVE HYDRAULIC DRILL PROVIDED WITH A SHANK EQUIPPED WITH COUPLING SPLINES

(71) Applicant: MONTABERT, Saint-Priest (FR)

(72) Inventors: Michel Escolle, Nievroz (FR); Gilbert Chervin, Lyons (FR)

(73) Assignee: MONTABERT, Saint-Priest (FR)

( * ) Notice: Subject to any disclaimer, the term of this patent is extended or adjusted under 35 U.S.C. 154(b) by 0 days.

(21) Appl. No.: 17/916,374

(22) PCT Filed: Mar. 29, 2021

(86) PCT No.: PCT/FR2021/050547

§ 371 (c)(1),
(2) Date: Sep. 30, 2022

(87) PCT Pub. No.: WO2021/198605

PCT Pub. Date: Oct. 7, 2021

(65) Prior Publication Data

US 2023/0151699 A1 May 18, 2023

(30) Foreign Application Priority Data

Apr. 2, 2020 (FR) ..... 20/03324

(51) Int. Cl.
*E21B 6/04* (2006.01)
*E21B 17/03* (2006.01)

(52) U.S. Cl.
CPC ..... *E21B 17/03* (2013.01); *E21B 6/04* (2013.01)

(58) Field of Classification Search
CPC ..... E21B 1/38; E21B 1/00; E21B 1/02; E21B 1/12; E21B 6/00; E21B 6/04
See application file for complete search history.

(56) References Cited

U.S. PATENT DOCUMENTS 6,290,002 B1 * 9/2001 Comeau ..... E21B 7/067 175/73
6,488,105 B1 * 12/2002 Wilcox ..... E21B 4/12 175/298

(Continued)

FOREIGN PATENT DOCUMENTS

| | | |
|---|---|---|
| EP | 0473968 A2 | 3/1992 |
| FR | 2761112 A1 | 9/1998 |
| FR | 3077752 A1 | 8/2019 |

OTHER PUBLICATIONS

International Search Report; International Application No. PCT/FR2021/050547 filed Mar. 29, 2021; Date of Completion of International Search Jul. 8, 2021; Date of Mailing of International Search Report dated Jul. 22, 2021; 2 pages.

(Continued)

*Primary Examiner* — Shane Bomar
(74) *Attorney, Agent, or Firm* — CANTOR COLBURN LLP

(57) ABSTRACT

A rotary percussive hydraulic drill comprises a body; a shank having female coupling splines and male coupling splines; a striking piston configured to strike the shank; a rotation drive device configured to drive the shank in rotation; a front abutment surface against which the shank is configured to come into abutment. The shank has an annular bearing flange which is provided on an outer surface of the shank and which has an annular bearing surface configured to come into abutment against the front abutment surface. Each of the female and male coupling splines provided on the shank extends from the annular bearing flange in the direction of the striking piston, wherein a connecting surface of each female coupling spline provided on the shank being at least in part formed by a curved concave surface extending substantially in an extension direction of the respective female coupling spline and having a radius of curvature (Continued)

which is less than a radial height of each of the male coupling splines provided on the shank.

20 Claims, 2 Drawing Sheets

(56) References Cited

U.S. PATENT DOCUMENTS

| | | | | |
|---|---|---|---|---|
| 2002/0070049 | A1* | 6/2002 | Klemm | E21B 17/076 175/26 |
| 2015/0322784 | A1* | 11/2015 | Liu | E21C 27/28 299/10 |
| 2021/0001462 | A1 | 1/2021 | Comarmond | |
| 2022/0274240 | A1* | 9/2022 | Cheylus | B25D 9/12 |
| 2022/0274242 | A1* | 9/2022 | Cheylus | E21B 1/26 |
| 2022/0339768 | A1* | 10/2022 | Escolle | B25D 17/22 |

OTHER PUBLICATIONS

Written Opinion of International Application No. PCT/FR2021/050547 filed Mar. 29, 2021; Not in English, Translation not Available; 8 pages.

International Search Report; International Application No. PCT/FR2021/050547 filed Mar. 29, 2021; Date of Completion of International Search Jul. 8, 2021; Date of Mailing of International Search Report dated Jul. 22, 2021; Not in English; 4 pages.

* cited by examiner

ROTARY PERCUSSIVE HYDRAULIC DRILL PROVIDED WITH A SHANK EQUIPPED WITH COUPLING SPLINES

CROSS REFERENCE TO RELATED APPLICATIONS

This application is a National Stage of PCT Application No. PCT/PCT/FR2021/050547 filed on Mar. 29, 2021, which claims priority to French Patent Application No. 20/03324 filed on Apr. 2, 2020, the contents each of which are incorporated herein by reference thereto.

TECHNICAL FIELD

The present invention relates to a rotary percussive hydraulic drill more especially used on a drilling installation.

BACKGROUND

A drilling installation comprises, in known manner, a rotary percussive hydraulic drill slidably mounted on a slide and driving one or more drilling bars, the last of these drilling bars carrying a tool called a cutting edge which in contact with the rock. The objective of such a drill is generally to drill more or less deep holes in order to be able to place explosive charges therein. The drill is therefore the main element of a drilling installation which, on the one hand, gives the cutting edge the setting in rotation and the setting in percussion through the drilling bars so as to penetrate the rock, and, on the other hand, provides an injection fluid so as to extract the debris from the drilled hole.

A rotary percussive hydraulic drill more particularly comprises, on the one hand, a striking device which is driven by one or more hydraulic fluid flow rates coming from a main hydraulic supply circuit and which comprises a striking piston configured to strike, at each operating cycle of the drill, a shank coupled to the drilling bars, and, on the other hand, a rotation driving device provided with a hydraulic rotary motor and configured to rotate the shank and the drilling bars.

The rotation driving device comprises in particular a coupling member which is disposed around the shank and which comprises male coupling splines and female coupling splines respectively rotatably coupled with female coupling splines and male coupling splines provided on the outer surface of the shank. The male and female coupling splines provided on the shank extend substantially parallel to an extension axis of the shank and are angularly offset from each other with respect to the extension axis of the shank.

When blocking in the rock of the cutting edge, the rotary percussive hydraulic drill is retracted until the front ends of the male coupling splines provided on the shank abut against a front abutment surface provided on a front abutment member which is fixed to the body of the rotary percussive hydraulic drill.

Then, in an attempt to unlock the tool, the rotation driving device and/or the striking device can be activated so as to drive the shank in rotation and/or to have an impact on the latter with the striking piston.

Such activation of the rotation driving device and/or of the striking device induces rotational friction of the male coupling splines provided on the shank against the front abutment surface and/or axial shocks of the male coupling splines provided on the shank against the front abutment surface.

However, such repeated axial shocks and rotational friction are likely to generate rapid wear of the male coupling splines provided on the shank, requiring a frequent replacement of the shank. In addition, such wear of the male coupling splines generates chips which are likely to get stuck between different moving parts of the rotary percussive hydraulic drill and therefore to damage the latter.

BRIEF SUMMARY

The present disclosure aims to remedy all or part of these drawbacks.

The technical problem underlying the present disclosure is therefore consists in providing a rotary percussive hydraulic drill which is simple in structure, economical and reliable, while being compact.

To this end, the present disclosure relates to a rotary percussive hydraulic drill including:

- a body,
- a shank intended to be coupled to at least one drilling bar equipped with a tool, the shank including a coupling part comprising female coupling splines and male coupling splines which are angularly offset from each other others with respect to the extension axis of the shank,
- a striking piston slidably mounted inside the body along a striking axis and configured to strike the shank,
- a rotation driving device which is configured to drive the shank in rotation about an axis of rotation substantially coincident with the striking axis, the rotation driving device comprising a coupling member disposed around the shank, the coupling member comprising male coupling splines and female coupling splines which are respectively rotatably coupled with the female and male coupling splines of the shank,
- a front abutment surface which is fixed with respect to the body, the front abutment surface being annular and extending around the shank, the shank being configured to abut against the front abutment surface so as to limit the displacement stroke of the shank forwards, characterized in that the shank includes an annular bearing flange which is provided on an outer surface of the shank and which includes an annular bearing surface configured to abut against the front abutment surface, and in that each of the female and male coupling splines provided on the shank extends from the annular bearing flange and in the direction of the striking piston, each female coupling spline provided on the shank including a bottom surface and a connecting surface which connects the respective bottom surface to the annular bearing flange and which extends forwards away from the extension axis of the shank, the connecting surface of each female coupling spline provided on the shank being at least in part formed by a curved concave surface extending substantially in the extension direction of the respective female coupling spline and having a radius of curvature which is less than the radial height of each of the male coupling splines provided on the shank.

The presence of such an annular bearing flange at the front of the female and male coupling splines provided on the shank makes it possible to avoid contact between the front abutment surface and the male coupling splines provided on the shank, and therefore to preserve the integrity of the latter.

In addition, the presence of an annular bearing surface on the annular bearing flange ensures a relatively large contact surface between the front abutment surface and the annular bearing flange, and therefore a better distribution of the forces of impact and/or friction applied by the shank against the front abutment surface.

Thus, the specific configuration of the rotary percussive hydraulic drill according to the present disclosure gives the shank a substantially increased service life, which makes it possible to significantly reduce the periods of immobilization of the drill to replace the shank, and risk of damage to the drill that could affect the safety of users.

Furthermore, given that the male coupling splines provided on the shank extend directly from the annular bearing flange, the axial length of the shank is not affected by the presence of the annular bearing flange, which makes it possible to obtain a compact rotary percussive hydraulic drill. The fact that each female coupling spline provided on the shank includes a connecting surface at least in part formed by a curved concave surface having a small radius of curvature makes it possible to further reduce the axial length of the shank, and therefore to further increase the compactness of the rotary percussive hydraulic drill.

The specific configuration of the connecting surface of each female coupling spline provided on the shank also makes it possible to avoid the presence of sharp angles likely to induce high stresses on the shank during operation of the drill, and therefore to induce ruptures of the shank.

The rotary percussive hydraulic drill may also have one or more of the following characteristics, taken alone or in combination.

According to one embodiment of the present disclosure, the female and male coupling splines provided on the shank extend substantially parallel to the extension axis of the shank.

According to one embodiment of the present disclosure, the connecting surface of each female coupling spline provided on the shank is entirely formed by the respective curved concave surface.

According to one embodiment of the present disclosure, the annular bearing flange has a maximum external diameter which is greater than or equal to the external diameter of the coupling part. Such a configuration of the coupling part makes it possible to reduce the cross section of the shank at the coupling part, and therefore to reduce the cross section of the coupling member, while retaining a large surface of protection. These arrangements thus make it possible to reduce the footprint of the rotary percussive hydraulic drill according to the present disclosure.

According to one embodiment of the present disclosure, the front end of each female coupling spline provided on the shank is provided on the annular bearing flange. According to one variant of the present disclosure, the front end of each female coupling spline provided on the shank could be adjacent to the annular bearing flange.

According to one embodiment of the present disclosure, the front end of each male coupling spline provided on the shank is adjacent to the annular bearing flange.

According to one embodiment of the present disclosure, each male coupling spline provided on the shank includes a top surface which extends from the annular bearing flange.

According to one embodiment of the present disclosure, for each male coupling spline provided on the shank, the radial distance between the extension axis of the shank and the top surface of said male coupling spline is substantially constant along said male coupling spline.

According to one embodiment of the present disclosure, the radius of curvature of each curved concave surface is less than 15 mm, and for example less than 10 mm. Such a value of the radius of curvature of the curved concave surface of each female coupling spline provided on the shank makes it possible to reduce the length of the connection between the bearing flange and the different coupling splines provided on the shank, and therefore to reduce the length of the shank. These arrangements thus make it possible to increase the compactness of the rotary percussive hydraulic drill according to the present disclosure.

According to one embodiment of the present disclosure, the connecting surface of each female coupling spline provided on the shank includes an inclined surface which is inclined with respect to the extension axis of the shank and which diverges in the direction of the front abutment surface. Advantageously, the inclined surface extends in the extension of the curved concave surface and in the direction of the front end of the shank.

According to one embodiment of the present disclosure, the annular bearing flange includes an external peripheral surface which is generally cylindrical.

According to one embodiment of the present disclosure, the front end of each female coupling spline provided on the shank opens into an external surface of the annular bearing flange.

According to one embodiment of the present disclosure, the front end of each female coupling spline provided on the shank opens into the external peripheral surface.

According to one embodiment of the present disclosure, the external peripheral surface extends in the extension of the annular bearing surface in the direction of the striking piston.

According to one embodiment of the present disclosure, the front end of each female coupling spline provided on the shank opens into the annular bearing surface of the annular bearing flange.

According to one embodiment of the present disclosure, the radial height of the annular bearing flange at an outlet of the front end of each female coupling spline provided on the shank is greater than 50%, and for example greater than or equal to 60 or 70%, of the maximum radial height of the annular bearing flange.

According to one embodiment of the present disclosure, each female coupling spline provided on the shank includes two lateral surfaces which extend longitudinally and which are substantially parallel.

According to one embodiment of the present disclosure, the annular bearing surface is inclined with respect to the striking axis and diverges in the direction of the striking piston. However, according to a variant of the present disclosure, the annular bearing surface could be perpendicular to the striking axis.

According to one embodiment of the present disclosure, the front abutment surface is provided on the body.

According to another embodiment of the present disclosure, the rotary percussive hydraulic drill includes an annular abutment ring which is disposed in the body, the annular abutment ring being disposed around the shank and including the front abutment surface.

According to one embodiment of the present disclosure, the coupling member includes external peripheral teeth rotatably coupled, for example directly or indirectly, with an output shaft of a drive motor belonging to the rotation driving device.

According to one embodiment of the present disclosure, the coupling member is a coupling pinion.

According to one embodiment of the present disclosure, the female coupling splines of the shank are evenly distributed about the extension axis.

According to one embodiment of the present disclosure, the male coupling splines of the coupling member are evenly distributed about the extension axis of the shank.

According to one embodiment of the present disclosure, the shank includes a first end portion facing the striking piston and provided with an end face against which the striking piston is intended to strike, and a second end portion, opposite to the first end portion, intended to be coupled to the at least one drilling bar.

According to one embodiment of the present disclosure, the coupling part is formed by the first end portion of the shank.

According to one embodiment of the present disclosure, the extension axis of the shank is parallel, and for example coincident, with the striking axis.

According to one embodiment of the present disclosure, the rotary percussive hydraulic drill includes a main hydraulic supply circuit configured to control reciprocating sliding of the striking piston along the striking axis.

According to one embodiment of the present disclosure, each of the female and male coupling splines provided on the shank extends to the rear end of the shank. According to one variant of the present disclosure, the rear end of each of the female and male coupling splines provided on the shank is spaced from the rear end of the shank.

According to one embodiment of the present disclosure, each of the female and male coupling splines provided on the shank has a useful length of less than 100 mm.

According to one embodiment of the present disclosure, the shank has, at the front of the annular bearing flange, a maximum diameter less than or equal to 61 mm, and advantageously less than 46 mm.

According to one embodiment of the present disclosure, the bottom surface of each female coupling spline provided on the shank is substantially flat.

BRIEF DESCRIPTION OF THE DRAWINGS

The invention will be better understood with the aid of the description which follows with reference to the appended schematic drawings showing, by way of non-limiting example, one embodiment of this rotary percussive hydraulic drill.

DETAILED DESCRIPTION

Figure 1:
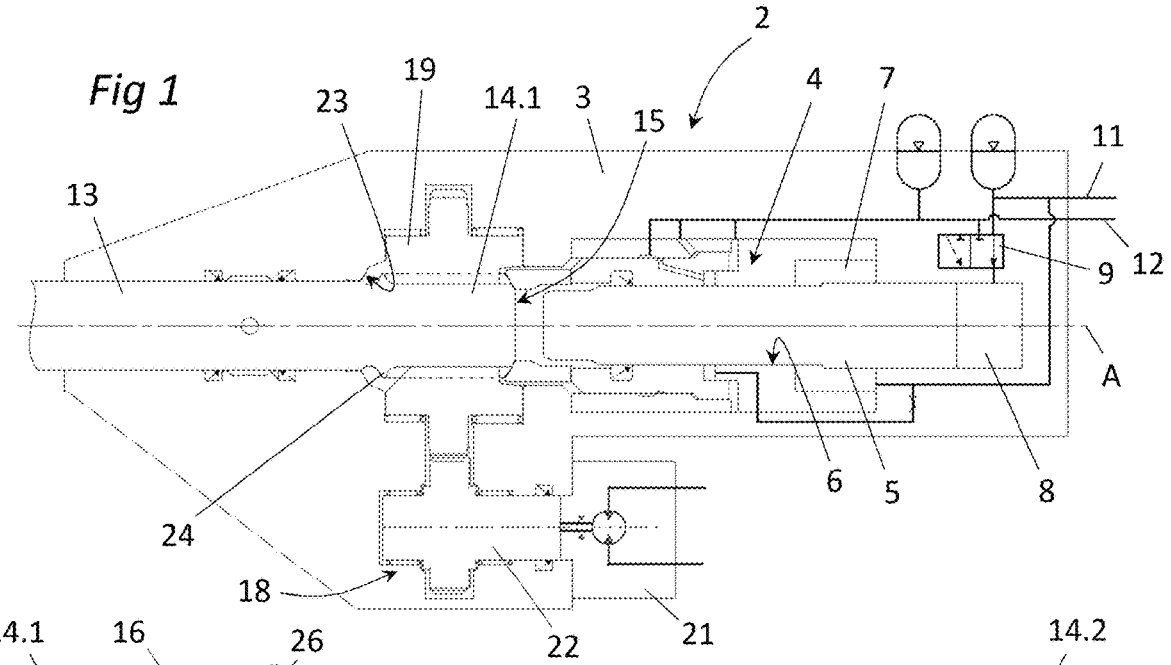
FIG. 1 is a schematic view in longitudinal section of a rotary percussive hydraulic drill according to a first embodiment of the present disclosure.
Figure 2:
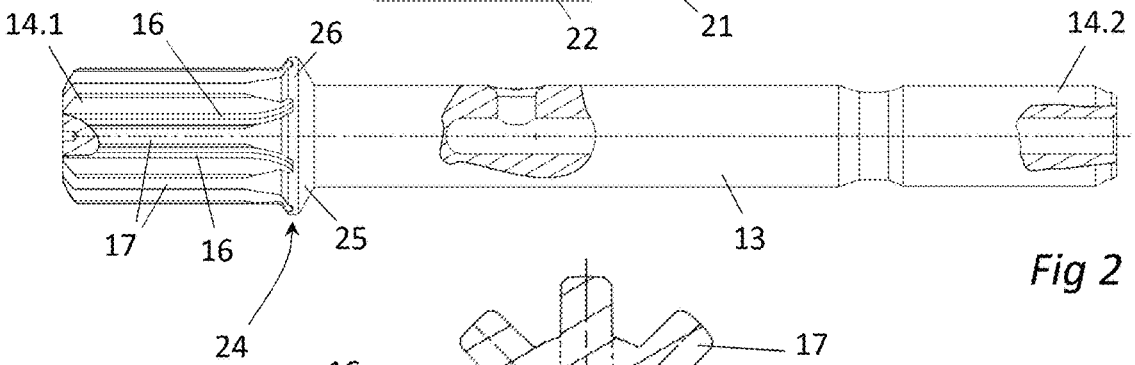
FIG. 2 is a side view of a shank belonging to the rotary percussive hydraulic drill of FIG. 1.
Figure 3:
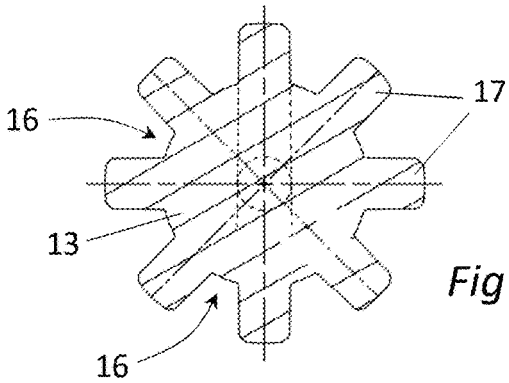
FIG. 3 is a cross-sectional view of the shank of FIG. 2.
Figure 4:
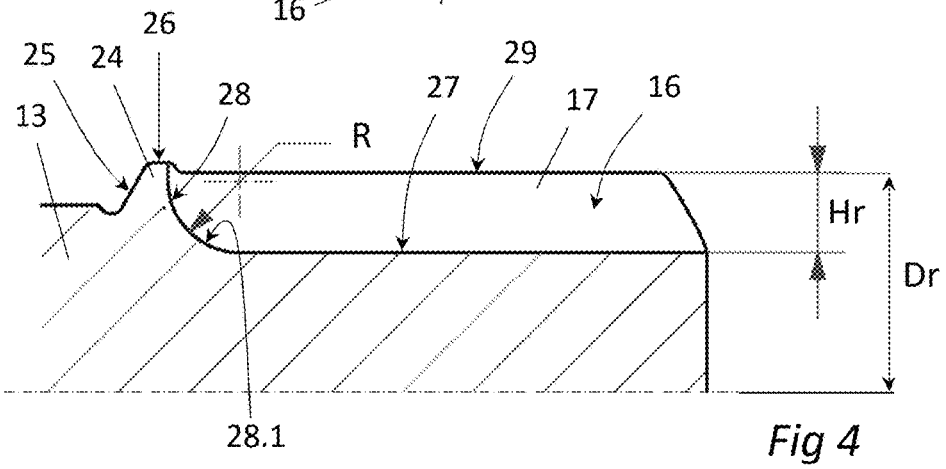
FIG. 4 is a partial view in longitudinal section of the shank of FIG. 2.

FIGS. 1 to 4 show a rotary percussive hydraulic drill 2 which is intended for the perforation of blast holes.

The rotary percussive hydraulic drill 2 comprises a body 3 which is configured to be slidably mounted on a slide.

The rotary percussive hydraulic drill 2 further comprises a striking device 4 including a striking piston 5 mounted to slide alternately in a piston cylinder 6 which is delimited by the body 3 and which extends along a striking axis A. The striking piston 5 and the piston cylinder 6 delimit a primary control chamber 7 which is annular, and a secondary control chamber 8 which has a section larger than that of the primary control chamber 7 and which is antagonistic to the primary control chamber 7.

The striking device 4 further comprises a control valve 9 arranged to control a reciprocating movement of the striking piston 5 within the piston cylinder 6 alternately following a striking stroke and a return stroke. The control valve 9 is configured to put the secondary control chamber 8, alternately in connection with a high pressure fluid supply duct 11, such as a high pressure incompressible fluid supply duct, during the striking stroke of the striking piston 5, and with a low pressure fluid return duct 12, such as an low pressure incompressible fluid return duct, during the return stroke of the striking piston 5. The primary control chamber 7 is advantageously continuously supplied with high pressure fluid by a supply channel.

The high pressure fluid supply duct 11 and the low pressure fluid return duct 12 belong to a main hydraulic supply circuit with which the striking device 4 is provided. The main hydraulic supply circuit can advantageously include a high pressure accumulator connected to the high pressure fluid supply duct 11.

The rotary percussive hydraulic drill 2 also includes a shank 13 intended to be coupled, in a known manner, to at least one drilling bar (not shown in the figures) equipped with a tool. The shank 13 extends longitudinally along an extension axis which is advantageously coincident with the striking axis A, and includes a first end portion 14.1 facing the striking piston 5 and provided with an end face 15 against which is intended to strike the striking piston 5 during each operating cycle of the rotary percussive hydraulic drill 2, and a second end portion 14.2, opposite to the first end portion 14.1, intended to be coupled to the at least one drilling bar.

The shank 13 includes a coupling part, which is formed for example by the first end portion 14.1, comprising female coupling splines 16 and male coupling splines 17 which extend for example parallel to the extension axis of the shank 13 and which are angularly offset from each other with respect to the extension axis of the shank 13. The female and male coupling splines 16, 17 are advantageously evenly distributed about the extension axis of the shank 13. Advantageously, each male coupling spline 17 is disposed between two adjacent female coupling splines 16.

Each of the female and male coupling splines 16, 17 includes a rear end which is oriented towards the striking piston 5 and a front end which is opposite to the respective rear end. According to the embodiment shown in FIGS. 1 to 4, each of the female and male coupling splines 16, 17 extends to the rear end of the shank 13. However, according to one variant of the present disclosure, the rear end of each of the female and male coupling splines 16, 17 could be spaced from the rear end of the shank 13.

The rotary percussive hydraulic drill 2 further includes a rotation driving device 18 which is configured to drive the shank 13 in rotation about an axis of rotation which is substantially coincident with the striking axis A.

The rotation driving device 18 comprises a coupling member 19, such as a coupling pinion, which is tubular and which is disposed around the shank 13. The coupling member 19 comprises male coupling splines and female coupling splines which are rotatably coupled with the female and male coupling splines 16, 17 of the shank 13, respectively. The male coupling splines and the female coupling splines provided on the coupling member 19 are evenly distributed about the extension axis of the shank 13.

Advantageously, the coupling member 19 includes external peripheral teeth rotatably coupled with an output shaft of a drive motor 21, such as a hydraulic motor supplied hydraulically by a hydraulic supply external circuit, belonging to the rotation driving device 18. The rotation driving device 18 may for example include an intermediate pinion 22 which is coupled, on the one hand, to the output shaft of the drive motor 21 and, on the other hand, to the external peripheral teeth of the coupling member 19.

The rotary percussive hydraulic drill 2 further includes a front abutment surface 23 which is annular and which extends around the shank 13. The front abutment surface 23 is located opposite the striking piston 5 with respect to the coupling member 19. The front abutment surface 23 may be provided directly on the body 3, or may be provided on an annular abutment ring which is disposed in the body 3.

The shank 13 includes an annular bearing flange 24 which is provided on an outer surface of the shank 13. The annular bearing flange 24 includes an annular bearing surface 25 configured to abut against the front abutment surface 23 so as to limit the displacement stroke of the shank 13 forwards. Advantageously, the annular bearing surface 25 is inclined with respect to the striking axis A and diverges in the direction of the coupling part of the shank 13.

According to the embodiment shown in FIGS. 1 to 4, the annular bearing flange 24 further includes an external peripheral surface 26 which is generally cylindrical and which extends in the extension of the annular bearing surface 25 in the direction of the rear end of the shank 13. The external peripheral surface 26 advantageously has an external diameter which is greater than or equal to the external diameter of the coupling part.

Advantageously, each female and male coupling spline 16, 17 extends from the annular bearing flange 24 in the direction of the rear end of the shank 13. According to the embodiment shown in FIGS. 1 to 4, the front end of each female coupling spline 16 is provided on the annular bearing flange 24 and opens into an external surface of the annular bearing flange 24 and for example into the external peripheral surface 26.

According to the embodiment shown in FIGS. 1 to 4, each female coupling spline 16 includes a bottom surface 27 which is substantially planar and which extends in the extension direction of said female coupling spline, and a connecting surface 28 which connects the respective bottom surface 27 to the annular bearing flange 24 and which extends forwards away from the extension axis of the shank 13. According to the embodiment shown in FIGS. 1 to 4, the connecting surface 28 of each female coupling spline 16 is entirely formed by a curved concave surface 28.1 extending in the extension direction of the respective female coupling spline 16 and having a radius of curvature R which is less than the radial height Hr of each of the male coupling splines 17 provided on the shank 13. The radius of curvature R of each curved concave surface 28.1 is advantageously less than 15 mm, and is for example less than 10 mm.

Each female coupling spline 16 may for example have a rectangular cross section, and therefore have two lateral surfaces which extend longitudinally and which are substantially parallel. However, each female coupling spline 16 could have a generally V-shaped cross section.

According to the embodiment shown in FIGS. 1 to 4, for each male coupling spline 17, the radial distance D R between the extension axis of the shank 13 and a top surface 29 of said male coupling spline 17 is substantially constant along said male coupling spline.

When blocking in the rock of the cutting edge, the rotary percussive hydraulic drill 2 is retracted until the annular bearing surface 25 of the annular bearing flange 24 abuts against the front abutment surface 23.

Then, in order to unlock the cutting edge, the rotation driving device 18 is activated so as to drive the shank 13 in rotation. The striking device 4 could also be activated simultaneously with the rotation driving device 18 so as to have also an impact on the shank 13 with the striking piston 5.

Such activation of the rotation driving device 18 and possibly of the striking device 4 induces rotational friction of the annular bearing surface 25 of the annular bearing flange 24 against the front abutment surface 23 and potential axial shocks of the annular bearing surface 25 against the front abutment surface 23.

The presence of the annular bearing flange 24 at the front of the female and male coupling splines 16, 17 provided on the shank 13 makes it possible to avoid contact between the front abutment surface 23 and the male coupling splines 17 provided on the shank 13, and therefore to preserve the integrity of the latter. In addition, the fact that the annular bearing surface 25 is annular ensures a relatively large contact surface between the front abutment surface 23 and the annular bearing flange 24, and therefore a better distribution of the impact forces applied by the shank 13 against the front abutment surface 23.

Thus, the specific configuration of the rotary percussive hydraulic drill 2 according to the present disclosure gives the shank 13 a significantly increased service life, which makes it possible to significantly reduce the periods of immobilization of the rotary percussive hydraulic drill 2 for replace the shank 13, and the risk of damaging the rotary percussive hydraulic drill 2 by wear particles from the shank 13.

In addition, given that the male coupling splines 17 provided on the shank 13 extend directly from the annular bearing flange 24, the axial length of the shank 13 is not affected by the presence of the annular bearing flange 24, which makes it possible to obtain a rotary percussive hydraulic drill 2 which is compact.

Figure 5:
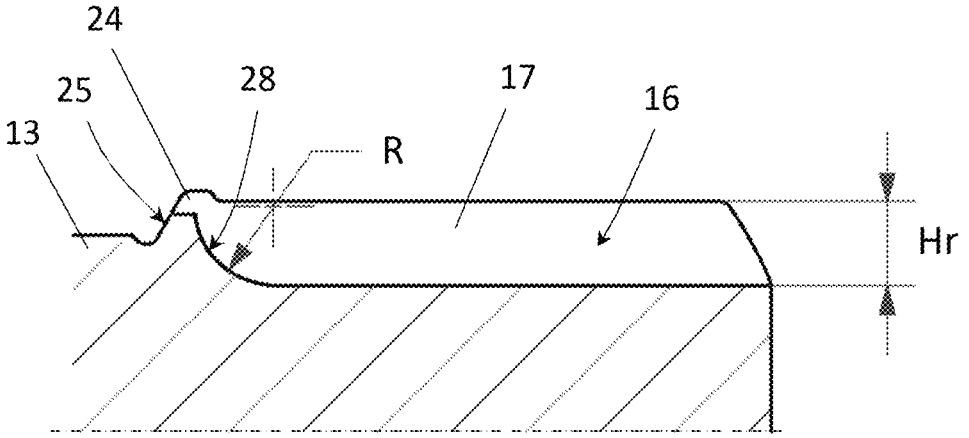
FIG. 5 is a partial view in longitudinal section of the shank of a rotary percussive hydraulic drill according to a second embodiment of the present disclosure.

FIG. 5 shows the shank 13 of a rotary percussive hydraulic drill 2 according to a second embodiment of the present disclosure which differs from the first embodiment shown in FIGS. 1 to 4 essentially in that the front end of each female coupling spline 16 opens into the annular bearing surface 25 of the annular bearing flange 24. According to such an embodiment of the present disclosure, the radial height of the annular bearing flange 24 at an outlet of the front end of each female coupling spline 16 is greater than 50%, and for example greater than or equal to 60 or 70%, of the maximum radial height of the annular bearing flange 24.

As goes without saying, the present disclosure is not limited to the sole embodiment of this rotary percussive hydraulic drill, described above by way of example, it embraces on the contrary all the variants thereof.

The invention claimed is:

1. A rotary percussive hydraulic drill comprising:

a body, a shank intended to be coupled to at least one drilling bar equipped with a tool, the shank including a coupling part comprising female coupling splines and male coupling splines which are angularly offset from each other with respect to an extension axis of the shank, a striking piston slidably mounted inside the body along a striking axis and configured to strike the shank, a rotation driving device which is configured to drive the shank in rotation about an axis of rotation substantially coincident with the striking axis, the rotation driving device comprising a coupling member disposed around the shank, the coupling member comprising male coupling splines and female coupling splines which are respectively rotatably coupled with the female coupling splines and male coupling splines of the shank, a front abutment surface which is fixed with respect to the body, the front abutment surface being annular and extending around the shank, the shank being configured to abut against the front abutment surface so as to limit a displacement stroke of the shank forwards, wherein the shank includes an annular bearing flange which is provided on an outer surface of the shank and which includes an annular bearing surface configured to abut against the front abutment surface, and wherein each of the female coupling splines and male coupling splines provided on the shank extends from the annular bearing flange and in a direction of the striking piston, each female coupling spline provided on the shank including a bottom surface and a connecting surface which connects the respective bottom surface to the annular bearing flange and which extends forwards away from the extension axis of the shank, the connecting surface of each female coupling spline provided on the shank being at least in part formed by a curved concave surface extending substantially in an extension direction of a respective female coupling spline and having a radius of curvature which is less than a radial height of each of the male coupling splines provided on the shank.

2. The rotary percussive hydraulic drill according to claim 1, wherein the annular bearing flange has a maximum external diameter which is greater than or equal to the external diameter of the coupling part.

3. The rotary percussive hydraulic drill according to claim 1, wherein a front end of each female coupling spline provided on the shank is provided on the annular bearing flange.

4. The rotary percussive hydraulic drill according to claim 1, wherein each male coupling spline provided on the shank includes a top surface which extends from the annular bearing flange.

5. The rotary percussive hydraulic drill according to claim 1, wherein the connecting surface of each female coupling spline provided on the shank is entirely formed by the respective curved concave surface.

6. The rotary percussive hydraulic drill according to claim 1, wherein each of the female coupling splines and male coupling splines provided on the shank extends to a rear end of the shank.

7. The rotary percussive hydraulic drill according to claim 1, wherein the radius of curvature of each curved concave surface is less than 15 mm.

8. The rotary percussive hydraulic drill according to claim 1, wherein the annular bearing flange includes an external peripheral surface which is generally cylindrical.

9. The rotary percussive hydraulic drill according to claim 8, wherein a front end of each female coupling spline provided on the shank opens into the external peripheral surface.

10. The rotary percussive hydraulic drill according to claim 1, wherein a front end of each female coupling spline provided on the shank opens into the annular bearing surface of the annular bearing flange.

11. The rotary percussive hydraulic drill according to claim 10, wherein the radial height of the annular bearing flange at an outlet of a front end of each female coupling spline provided on the shank is greater than 50% of the maximum radial height of the annular bearing flange.

12. The rotary percussive hydraulic drill according to claim 1, wherein the annular bearing surface is inclined with respect to the striking axis and diverges in a direction of the striking piston.

13. The rotary percussive hydraulic drill according to claim 1, which includes an annular abutment ring which is disposed in the body, the annular abutment ring being disposed around the shank and including the front abutment surface.

14. The rotary percussive hydraulic drill according to claim 2, wherein a front end of each female coupling spline provided on the shank is provided on the annular bearing flange.

15. The rotary percussive hydraulic drill according to claim 14, wherein each male coupling spline provided on the shank includes a top surface which extends from the annular bearing flange.

16. The rotary percussive hydraulic drill according to claim 15, wherein the connecting surface of each female coupling spline provided on the shank is entirely formed by the respective curved concave surface.

17. The rotary percussive hydraulic drill according to claim 16, wherein each of the female coupling splines and male coupling splines provided on the shank extends to a rear end of the shank.

18. The rotary percussive hydraulic drill according to claim 17, wherein the radius of curvature of each curved concave surface is less than 15 mm.

19. The rotary percussive hydraulic drill according to claim 18, wherein the annular bearing flange includes an external peripheral surface which is generally cylindrical.

20. The rotary percussive hydraulic drill according to claim 19, wherein a front end of each female coupling spline provided on the shank opens into the external peripheral surface.

* * * * *